United States Patent [19]

Batten

[11] Patent Number: 4,862,773

[45] Date of Patent: Sep. 5, 1989

[54] COLLET TYPE FASTENER REMOVAL TOOL

[75] Inventor: Ronald W. Batten, Torrance, Calif.

[73] Assignee: V.S.I. Corporation, Culver City, Calif.

[21] Appl. No.: 225,359

[22] Filed: Jul. 28, 1988

[51] Int. Cl.[4] ..... B25B 13/50

[52] U.S. Cl. ..... 81/55; 81/13

[58] Field of Search ..... 81/55, 56, 13 X, 125, 81/54, 52, 437, 453

[56] References Cited

U.S. PATENT DOCUMENTS

| | | | |
|---|---|---|---|
| 3,323,395 | 6/1967 | Burnett et al. | 81/55 |
| 3,603,132 | 9/1971 | Holmes | 81/55 |
| 3,789,705 | 2/1974 | Naslund | 81/13 |
| 4,762,030 | 8/1988 | Nguyen | 81/55 |

*Primary Examiner*—Frederick R. Schmidt
*Assistant Examiner*—Lawrence Cruz
*Attorney, Agent, or Firm*—Plante; Strauss; Vanderburgh

[57] ABSTRACT

There is disclosed a tool for the removal of locking collars of the frangible fasteners used in the aerospace industry, particularly for removal of fasteners installed in close quarters such in a deep channel where conventional tools cannot grip the collar. The tool has a collet-type chuck to grasp the collar of the fastener and has a lead screw to lock the collet chuck about the collar and permit removal of the collar. For this purpose, the collet chuck has a cylindrical neck which is received within a sleeve. The lead screw is received in the opposite end of the collet sleeve and is threadably engaged in the internally threaded bore of the collet chuck member, preferably with left hand threads, and has a head with wrenching flats. The lead screw has a central axial through bore which receives a key member which is used to immobilize the stud or bolt of the fastener system. A disk member is slidably received within the collet sleeve to eject removed collars from the collet chuck member.

19 Claims, 3 Drawing Sheets

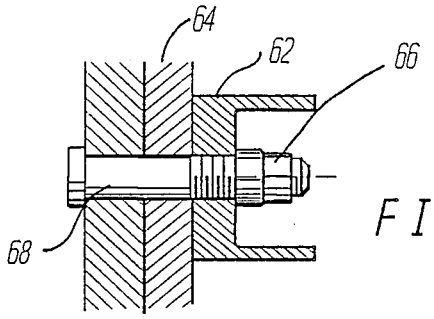
FIGURE 2
FIGURE 3
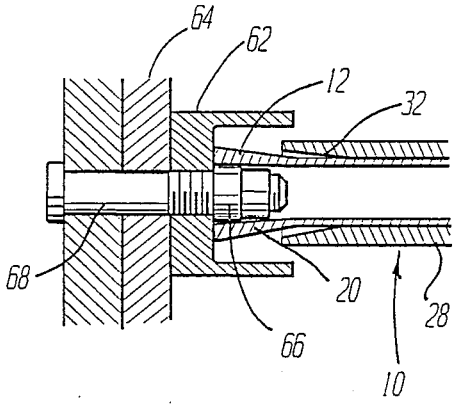
FIGURE 4
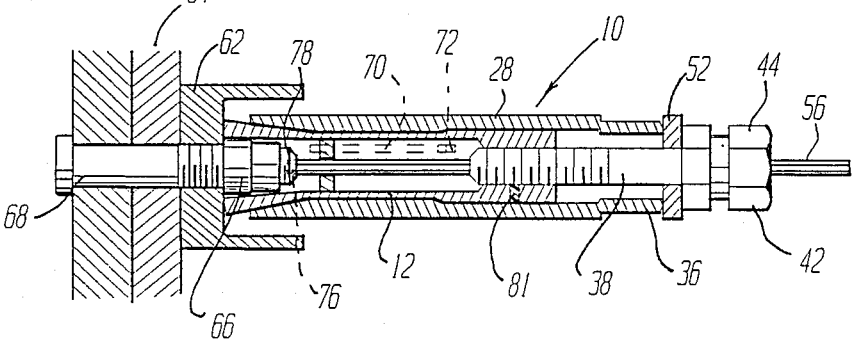

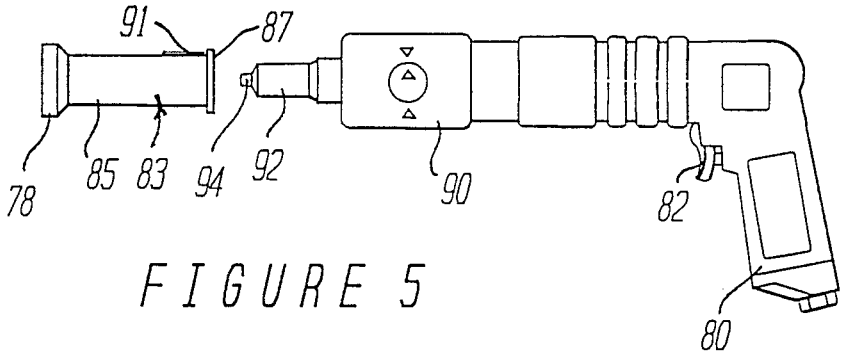
FIGURE 5
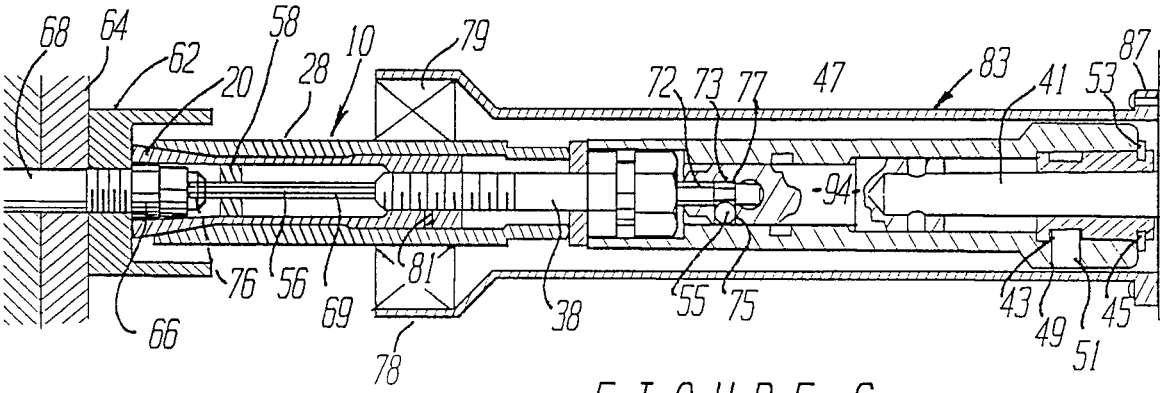
FIGURE 6
FIGURE 7
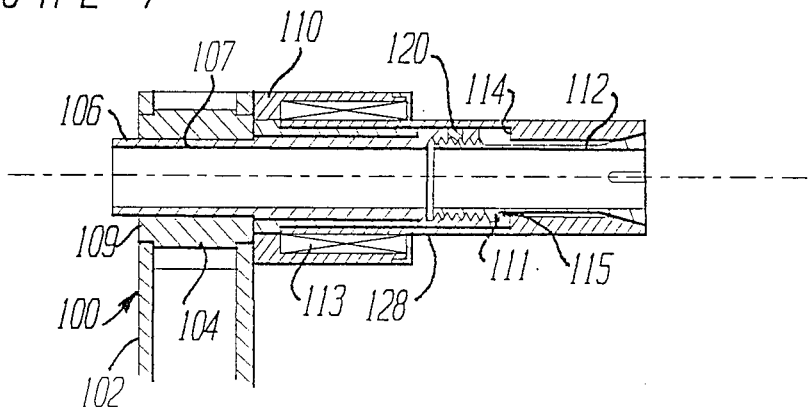

COLLET TYPE FASTENER REMOVAL TOOL

BACKGROUND OF THE INVENTION

1. Field of the Invention

This invention relates to a wrenching tool, and in particular to a tool useful for removal of fasteners which are in recessed locations.

2. Brief Statement of the Prior Art

Frangible fasteners are used extensively in the aerospace industry. These fasteners employ a threaded locking collar which is joined by a notched neck to a wrenching ring which shears from the collar when the applied torque exceeds a predetermined torsional loading. Often the threaded locking collar has an upset portion, usually a slightly elliptical shape to provide a frictional spring lock that prevents the collar from spinning off in the event that the residual tension on the fastener is lost.

These fasteners are applied with wrenching tools which engage the wrenching ring to apply the threaded collar and twist the wrenching ring from the threaded collar when the predetermined torsional loading is exceeded.

It is frequently desirable to loosen or remove threaded locking collars from assembled fasteners. Heretofore, no entirely suitable tool has been devised for this application. The threaded collar commonly has a cylindrical base which tapers into a smaller diameter cylindrical neck. The cylindrical portions of these collars are narrow and are difficult to grasp with conventional tools such as pliers, vise grip clamps, etc. The difficulties with removal are even more acute when the locking collars are recessed. This frequently occurs when the locking collars are seated within the channels and are inaccessible to most tools. Additionally, the use of non-standard tools for loosening or removing of the frangible fasteners is objectionable as such tools can damage the surfaces of the assembled parts.

BRIEF DESCRIPTION OF THE INVENTION

The invention is a tool for the removal of locking collars of the frangible fasteners used in the aerospace industry. The invention also includes the combination of the removal tool with a power driver. The removal tool is specifically intended for use in close quarters such as encountered when the collar of the fastener is received within a deep channel, inaccessible to conventional tools. The tool of the invention has a collet-type chuck member to grasp the collar which has a lead screw to lock collar in the collet chuck and permit its removal. For this purpose, the collet chuck member has a tapered base that is slotted to provide collet jaws, and has a cylindrical neck which is received within a sleeve. The collet chuck member has an internally threaded axial bore to receive a lead screw. The lead screw is received in the opposite end of the collet sleeve and is threadably engaged in the internally threaded axial bore of the collet chuck member, preferably with left hand threads. The lead screw has a central axial through bore which receives a key member which is used to immobilize the stud or bolt of the fastener system in loose or non-interference fit applications. A disk member is slidably received within the collet sleeve to eject removed collars from the collet chuck member.

BRIEF DESCRIPTION OF THE DRAWINGS

The invention will be described with reference to the FIGS. of which:

FIG. 2 is an elevational sectional view of a typical aerospace fastener;

FIG. 3 is an elevational sectional view of the removal tool of the as applied to the fastening collar of the fastener FIG. 2;

FIG. 4 is an elevational sectional view of the removal tool positioned to remove the collar of FIG. 2;

FIG. 5 illustrates a power-driven wrench and an adapter for use of the removal tool of the invention;

FIG. 6 is an elevational sectional view of the power-removal tool of the invention as applied to remove the fastener of 2; and FIG. 7 is an elevational sectional view of a right angle drive tool used with the removal tool of the invention.

DESCRIPTION OF PREFERRED EMBODIMENT

Figure 1:
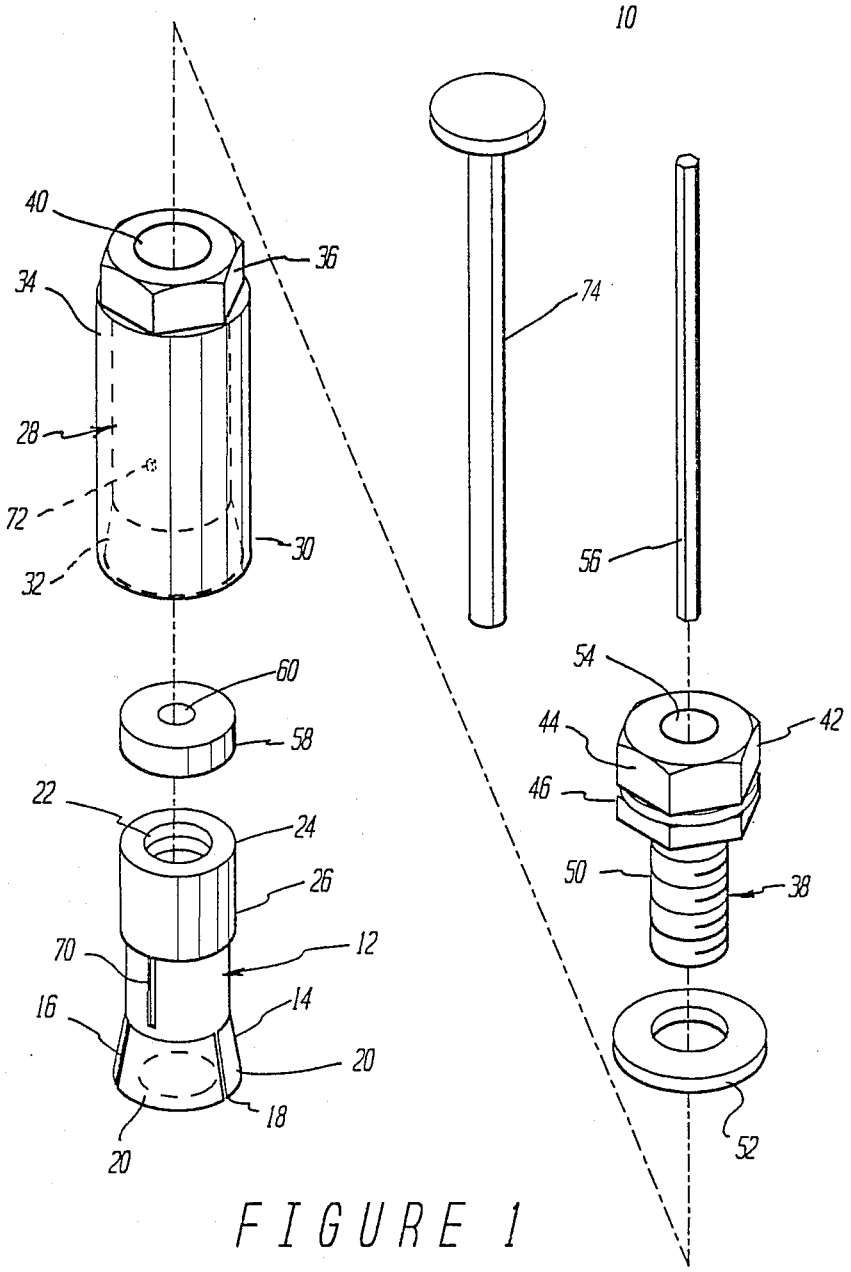
FIG. 1 is an exploded perspective view of the tool of the invention.

Referring now to FIG. 1 the invention is illustrated in exploded, perspective view. The removal tool 10 of the invention has a collet chuck member 12 which has a tapered base 14, with side walls 16 inclined to its longitudinal axis at an angle from 5 to about 25 degrees, preferably from about 10 to 15 degrees. The base 14 has at least one, and preferably three, axial slits 18, thereby dividing the base into a plurality of collet jaws 20. The collet chuck member 12 is hollow with a through bore 22 that is internally threaded at its upper end 24. The collet chuck member 12 has a cylindrical shank 26 which is received within a collet sleeve 28. Preferably, the collet chuck member 12 has an axial groove 70 which coacts with a key 72 on the inside wall of sleeve 28 to index the chuck member 12 to the sleeve 28 and prevent its rotation within the sleeve.

The collet sleeve 28 is cylindrical and, at its lower end 30 has a tapered counter bore 32 with the same taper as that of the base of the collet chuck member 12. At its upper end 34, the collet sleeve 28 has at least one wrenching flat 36 and, preferably, is hexagonally flatted to receive standard wrenches. A lead screw 38 extends through an axial through bore 40 of the collet sleeve 28. The lead screw 40 has a head 42 with at least one wrenching flat 44, and preferably is of a hexagonally flatted configuration, as shown for attachment of conventional wrenches. Preferably, the head 42 has an annular groove 46. A spring clip retainer 48 seats in groove 46. The body 50 of the lead screw 40 is externally threaded, preferably with left hand threads and extends into the internally threaded through bore 22 of the collet chuck member 12. A washer 52 is provided between the upper end 34 of the collet sleeve 28 and the underside of the head 42 of the lead screw 38. The lead screw 38 has a central, axial through bore 54 which is of sufficient diameter to receive a key member 56. The key member 56 is hexagonal in cross section and is a conventional key member that is used with the frangible fasteners to immobilize bolts in non-interference fit applications.

A disk member 58 is slidably received within the collet sleeve 28 and has a central through bore 60 for passage of the key member 56. As described hereinafter, the disk member 58 is used to eject a collar after its removal, thereby clearing the tool for reuse. An ejector rod 74 is provided with a slightly greater diameter than the key member 56 and greater than the diameter of the through bore 60. One can insert the ejector rod 74 through the lead screw to abut the disk member 58 and slide it forward, ejecting a collar from the collet chuck 12.

Referring now to FIG. 2, there is illustrated a typical installation found in the aerospace industry. A channel 62 is bolted to a supporting structure 64 with frangible fastener collar 66 and bolts 68. The locking collar 66 secures the assembly and infrequently require removal. Most conventional tools cannot be used for this removal as the collars 66 are cylindrical and are recessed within the channel 62 rendering the collars inaccessible to conventional gripping tools.

Referring now to FIG. 3, the removal tool 10 of the invention is shown as applied to the removal of the locking collar 66 shown in FIG. 2. As illustrated, the collet chuck member 12 has been extended from the collet sleeve 28 to permit the collet jaws 20 to spread sufficiently to be applied over the collar 66. In most applications, the jaws will engage the fastener in a slight frictional fit. The jaws preferably have gripping surfaces 19 which are outwardly beveled at an angle from 5 to about 10 degrees. It has been found that this causes the jaws to retract very slightly (about 0.005 inch) from the surface of the work piece when the collet clutch is tightened about the fastener. This insures that the face of the work piece will not be damaged by the removal of the fastener. Preferably, the gripping surfaces of the jaws are also serrated with grooves 21 at a depth of about 0.01 inch. The tool is in position for tightening of the collet jaws about the collar 66.

Referring now to FIG. 4, the collet chuck member has been retracted into the removal tool 10 by rotation of the lead screw 38. In this position, the collet chuck member 12 surrounds the locking collar 66 of the fastener. As the collet member is retracted in the assembly, collet jaws of the chuck close about the fastener collar. The collet chuck member 12 is restrained against rotation within the collet sleeve by the indexing groove 70 on the collet chuck member 12 and coacting key 72 on the inside wall of the collet sleeve 28.

The collet chuck member 12 can be tightened about the fastener collar by immobilizing the collet sleeve 28 against rotation with a wrench which grips the wrenching flats 36 on the end of the collet sleeve 28. The lead screw 38 is rotated by the application of torque to the lead screw head 42 with a conventional wrench. Once the fastener collar 66 is secured in the collet chuck member 12, the collet sleeve 28 is released and the continued application of torque to the lead screw 38 rotates the entire assembly, including the secured fastener collar 66. For this purpose, it is preferred that the threads on the lead screw 38 and the coacting threads on the internal axial bore of the collet chuck member 12 are left handed, thereby avoiding the reversal of the application of torque once the collet member 12 has seized the fastener collar 66. In non-interference fit applications, it is necessary to immobilize the bolt of the fastener during removal of the fastening collar. This is accomplished with the hexagonally flatted key member 56 which extends axially through the entire assembly and engages an internally broached hexagonal recess 76 in the end 78 of the fastener bolt 68.

At its opposite end, the key is secured with a conventional tool. After the fastener collar 66 has been removed from the fastener, it can be released from the collet chuck member 12 by reversing the torque applied to the lead screw 38, thereby retracting the lead screw from its threaded engagement with the collet chuck member 12. The collet chuck member 12 is thereby advanced out of its retention in the collet sleeve 28, permitting the jaws 20 of the collet chuck member 12 to open. As the fastener collar 66 is quite thin, it can wedge or jam in the collet chuck member 12. Accordingly, the ejection rod member 74 (see FIG. 1) is inserted into the tool to abut against disk member 58 and slide it against the collar and forcefully eject the collar.

Referring now to FIG. 5, there is illustrated a power-driven wrench and adapter useful with the removal tool in this invention. The power-driven wrench has a conventional pistol grip 80 with a trigger switch 82 and a housing 84 which typically contains an air motor. The output shaft of the air motor is engaged in a gear train within gear housing 90. The gear train has a centrally positioned output shaft which removably receives socket member 92 and a rotationally immobilized, and axially sliding key holder 94, which removably receives a key member, not shown.

The power-driven wrench is used with an adapter 83 which has a cylindrical sleeve 85 dependent from a base plate 87 which is fastened to the front of the gear housing 90. The sleeve 85 has an enlarged opposite end 78 to receive a directional control clutch. The base plate 87 is mounted to the gear housing 90 with retaining screws such as 91.

The power-driven wrench, adapter 83 and fastener removal tool 10 of the invention are shown in FIG. 6, in a position to remove fastener 66. The removal tool 10 has been placed over the fastener 66 in the same manner as described with reference to FIG. 4. The drive-motor wrench, as modified in accordance with this invention, is shown with its forward portion in cross-sectional view.

The adapter 83 is received over the removal tool 10 with the unidirectional Torrington clutch 79 which is housed in the enlarged end 78 engaging the sleeve 28 of the removal tool 10. This clutch is a commercially available roller clutch which has cams that prevent rotation in one direction, but freely permit rotation in the opposite direction. Preferably the clutch is selected to permit rotation in a counterclockwise direction as viewed by the operator, and is used with a removal tool having left-hand threads on the bolt 38 and collet sleeve 28.

The socket member 92 is received over the end of power output shaft 41, which has a first annular groove 43 and a second, smaller annular groove 45. The socket member 92 has an aperture 49 which receives a pin 51 which seats in annular groove 43 to secure the assembly. A retaining ring 53 is seated in the annular groove 45. The key member 56 has a working end 69 and a wrench end 71. The shank of the pin has a hexagonally flatted surface and is received in central bore 72 of the key holder 94 which is broached with a mating hexagonal flatted internal surface forming a receiving socket. The wrench end 71 of key has a distal grove 73. The key holder 94 also has a detent member cavity 75, which receives the detent member, which is a detent ball 55. The socket member 92 is provided with a detent member recess, preferably in the form an annular groove 77 at a preselected axial distance. In this position, the key holder 94 and key member 56 will slide together without any lateral force being exerted on the ball, since the key is bottomed against the end wall of bore, causing the two to move together in the direction retracting the key holder subassembly 94 is the drive assembly. The two members also will move together in the opposite direction, e.g., if the key member is pulled in an attempt to extract it, as a spring (not shown) is provided to bias the key holder subassembly to move outwardly.

The key member 56 is received in the recess 76 of the bolt 68 to immobilize the bolt. The key member 56 passes through the central bore of the disc 58 which is preferably fixedly secured to the key member 56 with a set screw (not shown). The reversing switch of the power-driven wrench is set to rotate the shaft in a counter clockwise direction, as viewed from the operator. This rotation will cause rotation of bolt 38 in counter clockwise rotation, drawing the collet member 12 into the removal tool and tightening the collet about the fastener 66. Preferably, the jaws 20 of the collet clutch 12 are sized for the particular fastener to provide a slight frictional engagement with the fastener when the collet clutch is open. This permits advancing of bolt 38 and drawing of the collet clutch into the collet sleeve 28 sufficiently to engage the fastener very tightly. The continued application of torque to the tool 10 will cause rotation of the fastener, loosening the fastener and removing it from the bolt.

The direction of rotation of the power-driven wrench is then reversed to a clockwise rotation, viewed from the operator. The collet sleeve 28 of the removal tool is restrained from rotational movement in the clockwise direction by the Torrington clutch 79 which is supported on the end of the adapter sleeve 85, resulting in retraction of bolt 38 of the tool. This loosens the collet member 12 and frees the fastener 66 for ejection from the tool 10.

A plastic plug 81 is inserted in a bore in the collet clutch 12 to frictionally engage the threads of bolt 38, thereby providing a frictional lock between the threaded bolt and collect clutch. This insures that the collect member 12 and bolt 38 will move together, once the frictional lock of the collect 12 in collect sleeve 28 has been broken. The spring of the power-driven wrench is biased to move the key member subassembly outwardly. This causes the key member 56 to advance disc 58 driving it against the fastener 66 and ejecting the fastener from the collet.

The entire operation can be automated with a self-reversing power-driven wrench, i.e., a wrench with a power drive which automatically reverses rotational direction when the trigger switch 82 is released.

Referring now to FIG. 7, the removal tool 10 is shown in combination with a right angle drive wrench 100 which has a handle 102 and a ratcheting gear 104 which receives a drive sleeve 106. The drive sleeve has one end with standard socket flats 107 to permit it to be seated in the socket receptacle 109 of gear 104. At its opposite end, the drive sleeve 126 has internal threads 111, which preferably are left-handed. Also, preferably, the opposite end also is of slightly greater diameter to provide an edge 115.

The wrench 100 is modified for this application by the permanent attachment of sleeve 110 which internally receives the unidirectional Torrington type clutch 113. The collet sleeve 128 is received within sleeve 110 and clutch 113. This sleeve has an enlarged diameter counterbore 114 to receive the drive sleeve 106 with the edge face 115 abutting against the internal shoulder within the collet sleeve 128. The threaded end of the collet chuck 112 is received in the internally threaded end of the drive sleeve 106. Preferably, an aperture is provided in the side wall of sleeve 106 which extends through the internal threads, and a plastic plug 120 is seated in this aperture to serve as a thread lock, thereby insuring that the sleeve 106 and collect clutch 112 will move together after the collect sleeve 128 has been loosened from the collect clutch 112. The operation of this tool is substantially the same as for those previously described. The collect clutch 112 is secured about a fastener collar to remove the collar. Thereafter, reverse rotation of the drive wrench will loosen the collect sleeve from the collect clutch and permit removal of the collar from the collect clutch.

The tool of the invention can also be used with a torque control wrench for the application of fasteners. In this application, the collet clutch and bolt are provided with right hand threads so that the collet clutch can be locked onto a fastener which has been started on a bolt and then used to tighten the fastener until the torque wrench clutch releases the applied torque. The wrench is then reversed in rotation, releasing the fastener.

As previously mentioned, the inside surfaces of the jaws of the collet clutch are preferably provided with serrations which are about 0.01 inch in depth. These serrations permit gripping of fasteners such as Eddie Bolt fasteners, which have a narrow cylindrical base and a lobed collar.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A fastener collar removal tool which comprises:

a. a cylindrical collet chuck member having an outwardly flared base with at least one axial slit to form collet jaws and an upper cylindrical neck having an internally threaded bore;

b. a collet sleeve having at least one external flat and an axial through bore of an internal diameter to receive said collet chuck member with its lower end flared outwardly to receive said base;

c. a lead screw having a head with at least one wrenching flat and a threaded shank with an axial through bore and received in said axial through bore of said collet sleeve and threadably engaged in said internally threaded bore of said collet chuck member; and d. an elongated key having at least one continuous flat slidably received in said axial through bore of said lead screw.

2. The tool of claim 1 wherein said internal threads on said collet chuck member and said external threads of the shank of said lead screw are left hand threads.

3. The tool of claim 1 wherein said neck of said collet chuck member bears index means to restrain its rotational movement within said collet sleeve.

4. The tool of claim 3 wherein said index means is an axial slot along the external wall of said neck and wherein said collet sleeve has a coacting key on the inside wall of its axial through bore.

5. The tool of claim 1 including at least one wrenching flat on the upper external wall of said collet sleeve.

6. The tool of claim 1 wherein the head of said lead screw has an annular groove with a circular spring received in said annular groove.

7. The tool of claim 1 including a washer between the head of said lead screw and the upper end of said collect sleeve.

8. The tool of claim 1 including a disc member slidably received within said collect chunk.

9. The tool of claim 1 in combination with an adapter sleeve surrounding said collect sleeve with an annulus therebetween, an annular unidirectional rotational clutch received in said annulus and engaging the outer wall of said collect sleeve and fixely secured to the inner wall of said adapter sleeve, and mounting means carried by said adapter sleeve for fixely securing said adapter sleeve to a power drive tool.

10. The tool of claim 9 wherein said mounting means is a radial flange distally carried by said adapter sleeve.

11. The tool of claim 10 in further combination with a power drive tool having a housing with a front face with a centrally positioned, rotationally driven shaft, a drive socket received on the end of said rotationally driven shaft, with the head of said lead screw received in said drive socket and with the mounting flange of said adapter sleeve fixedly secured to the front face of said power drive tool.

12. The tool of claim 11 wherein said unidirectional clutch freely permits clockwise rotation of the collet sleeve relative to said adapter sleeve, but prevents counterclockwise rotation thereof, said rotation being viewed from the collet end of said tool.

13. A tool for removal of cylindrical fasteners which comprises the combination of:

a. a power drive tool having a housing with a front face and a centrally positioned, rotationally driven shaft;

b. a drive socket received on the end of said rotationally driven shaft;

c. a cylindrical collet chuck member having an outwardly flared base with at least one axial slit to form collet jaws and an upper cylindrical neck having an internally threaded bore;

d. a collet sleeve having at least one external flat and an axial through bore of an internal diameter to receive said collet chuck member with its lower end flared outwardly to receive said base;

e. a lead screw having a head with at least one wrenching flat which is received in said drive socket, and a threaded shank with an axial through bore which is received in said axial through bore of said collet sleeve and threadably engaged in said internally threaded bore of said collet chuck member;

f. a sleeve adapter surrounding said collet sleeve with an annulus therebetween and distally supporting a radial mounting flange which is fixedly secured to the front face of the housing of said drive tool; and g. an annular unidirectional rotational clutch received in said annulus and engaging the outer wall of said collet sleeve and fixedly secured to the inner wall of said sleeve adapter.

14. The tool of claim 13 wherein said unidirectional clutch freely permits clockwise rotation of the collet sleeve relative to said adapter sleeve, but prevents counterclockwise rotation thereof, said rotation being viewed from the collet end of said tool.

15. The tool of claim 13 in further combination with an elongated key having at least one continuous flat slidably received in said axial through bore of said lead screw.

16. The tool of claim 15 including a second socket coaxially received within said drive socket and with said elongated key received in said second socket.

17. The tool of claim 16 wherein said second socket is distally carried on a key shaft which is coaxial with, and slidably received within said drive socket.

18. The tool of claim 17 wherein said key shaft is resiliently biased towards said drive socket.

19. The tool of claim 18 including a disk member slidably received within said through bore of said collet chuck member and fixedly secured to said key member whereby said key member and said disc member are resiliently biased to eject fasteners from said collet chuck member.

* * * * *

UNITED STATES PATENT AND TRADEMARK OFFICE

CERTIFICATE OF CORRECTION

PATENT NO. : 4,862,773

DATED : September 5, 1989

INVENTOR(S) : Ronald W. Batten

It is certified that error appears in the above-identified patent and that said Letters Patent is hereby corrected as shown below:

In the Claims:

Claim 1, column 6, line 41, after "flat" insert --whereby said sleeve can be restrained against rotation --

Signed and Sealed this

Twenty-sixth Day of June, 1990

*Attest:*

HARRY F. MANBECK, JR.

*Attesting Officer*

*Commissioner of Patents and Trademarks*